US007564230B2

(12) United States Patent
Liwinski

(10) Patent No.: US 7,564,230 B2
(45) Date of Patent: Jul. 21, 2009

(54) VOLTAGE REGULATED POWER SUPPLY SYSTEM

(75) Inventor: Henry Liwinski, North Wales, PA (US)

(73) Assignee: Anadigics, Inc., Warren, NJ (US)

( * ) Notice: Subject to any disclaimer, the term of this patent is extended or adjusted under 35 U.S.C. 154(b) by 241 days.

(21) Appl. No.: 11/329,449

(22) Filed: Jan. 11, 2006

(65) Prior Publication Data

US 2007/0159145 A1 Jul. 12, 2007

(51) Int. Cl.
*G05F 1/00* (2006.01)

(52) U.S. Cl. ..... 323/280; 323/273; 323/274; 323/313

(58) Field of Classification Search ..... 323/273, 323/274, 280, 313
See application file for complete search history.

(56) References Cited

U.S. PATENT DOCUMENTS 4,375,614 A * 3/1983 Steiner ..... 323/280
4,574,232 A * 3/1986 Petty ..... 323/268
4,988,953 A * 1/1991 Bollons ..... 330/261
5,262,682 A * 11/1993 Mitsuya et al. ..... 327/256
5,287,044 A * 2/1994 Izawa et al. ..... 318/400.3
5,961,215 A * 10/1999 Lee et al. ..... 374/178
6,130,529 A * 10/2000 Andres et al. ..... 323/303
6,150,801 A * 11/2000 Schwertlein et al. ..... 323/280
6,157,244 A * 12/2000 Lee et al. ..... 327/539
6,184,664 B1 * 2/2001 Ponzetta ..... 323/274
6,188,211 B1 * 2/2001 Rincon-Mora et al. ..... 323/280
6,201,375 B1 * 3/2001 Larson et al. ..... 323/277
6,265,856 B1 * 7/2001 Cali' et al. ..... 323/273
6,340,852 B1 * 1/2002 Mizoguchi ..... 307/125
6,677,736 B1 * 1/2004 Barnes et al. ..... 323/280
7,071,664 B1 * 7/2006 Teggatz et al. ..... 323/280
2001/0033153 A1 * 10/2001 Pohlman ..... 323/274
2003/0013284 A1 * 1/2003 Emrick et al. ..... 438/575

* cited by examiner

*Primary Examiner*—Akm E Ullah
*Assistant Examiner*—Arun Williams
(74) *Attorney, Agent, or Firm*—William L. Botjer

(57) ABSTRACT

A voltage regulator for providing a regulated voltage is disclosed. The voltage regulator comprises an error amplifying module and a regulator. The error amplifying module provides a reference voltage, based on an output voltage to be regulated. The regulator provides a regulated output voltage based on the reference voltage. Voltage regulator provides stable output voltage against variations caused by power supply and load with a defined temperature coefficient.

20 Claims, 8 Drawing Sheets

VOLTAGE REGULATED POWER SUPPLY SYSTEM

BACKGROUND OF THE INVENTION

1. Field of the Invention

The invention relates generally to voltage regulators. More specifically, the invention relates to a compact voltage regulator which can be used with wireless communications devices.

2. Description of the Related Art

Modern wireless communications devices, such as Code Division Multiple Access (CDMA) telephones and other cellular telephones are held to ever-higher performance standards. Ongoing research work is being performed for communication devices to provide clear and undistorted transmission. To achieve this, linear power amplifiers are used in wireless communication devices. The linear power amplifiers require constant quiescent current through operating conditions to maintain linearity. To provide the constant quiescent current, a regulated voltage is needed.

Usually, a voltage regulator is implemented on a separate die and the regulated voltage is provided to the linear power amplifiers. In mobile phones, the voltage regulator may be a stand alone or integrated with other circuits. The requirement of an additional die increases the manufacturing cost. Therefore, to minimize the cost, there is a need for a compact voltage regulator which may be implemented on the same die as the linear power amplifier.

SUMMARY OF THE INVENTION

An object of the invention is to provide a constant bias current for power amplifier circuits.

Another object of the invention is to generate a regulated voltage independent from load and power supply.

Yet another object of the invention is to generate a regulated voltage with a desired temperature dependency.

Another object of the invention is to provide a compact voltage regulator.

Still another object of the invention is to provide a shutdown switch for the voltage regulator.

To achieve the above objectives, the invention provides a system for voltage regulation. The system includes an error amplifying module, and a regulator. The error amplifying module includes a bipolar junction transistor (BJT), and a diode. The regulator includes a field effect transistor (FET) and a resistor. The BJT amplifies the difference between a reference voltage and a desired value of output voltage ($V_{reg}$). The reference voltage $V_{ref}$ is the sum of voltages across the base-emitter junction of BJT, diode and resistor. Further, the reference voltage $V_{ref}$ is generated based on the output voltage, $V_{reg}$. The regulator regulates the variations in the output voltage, $V_{reg}$, based on the output of the error amplifying module. In one embodiment of the invention, a switch module is provided. The switch module includes a field effect transistor (FET). The switch module switches the system for voltage regulation in 'On' or 'Off' states.

The system provides a stable output voltage in case of variations due to power supply and load. The system provides a constant bias current to power amplifier circuits and other circuits which need a temperature defined power supply. Further, the system provides a voltage regulator that may be implemented on a single die, along with the circuit for which voltage is to be regulated. This minimizes the cost of manufacturing. In one embodiment of the invention, if the reference voltage is temperature independent, the system may provide voltage regulation independent of temperature.

BRIEF DESCRIPTION OF THE DRAWINGS

So that the manner in which the above recited features of the present invention can be understood in detail, a more particular description of the invention, briefly summarized above, may be had by reference to various embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Various embodiments of the invention provide a low power system for voltage regulation. The system for voltage regulation is, hereinafter, referred to as a voltage regulator. The voltage regulator includes an error amplifying module and a regulator. The error amplifying module amplifies the difference between a reference voltage and a desired value of an output voltage. The reference voltage is based on the output voltage to be regulated. The regulator regulates the output voltage based on the output of the error amplifying module. The voltage regulator further includes a switch module to set the voltage regulator in 'On' or 'Off' state.

Figure 1:
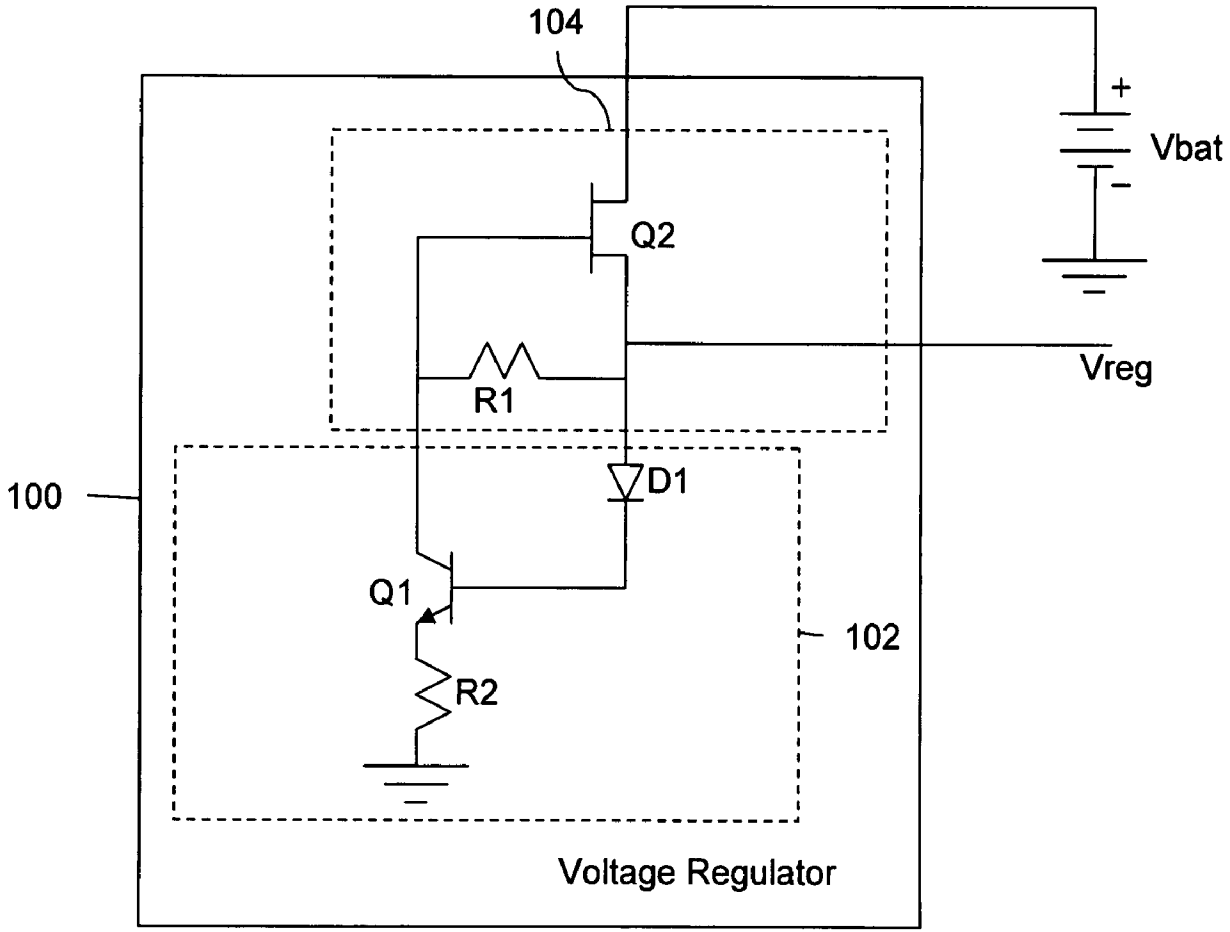
FIG. 1 is a schematic representation of a circuit diagram of a system for voltage regulation, in accordance with an embodiment of the invention.

FIG. 1 is a schematic representation of a circuit diagram of a voltage regulator 100, in accordance with an embodiment of the invention. Voltage regulator 100 includes an error amplifying module 102 and a regulator 104. Error amplifying module 102 includes a diode D1, a Bipolar Junction Transistor (BJT) Q1, and a resistor R2. Regulator 104 includes a Field Effect Transistor (FET) Q2, and a resistor R1. Diode D1 is connected between the source of FET Q2 and base of Q1. Resistor R2 is connected in series between the emitter of BJT Q1 and ground. Resistor R1 is connected between the gate and source of FET Q2. The collector of BJT Q1 is connected to the gate of FET Q2. Further, regulator 104 is connected to a battery, $V_{bat}$. $V_{bat}$ provides the necessary power required by voltage regulator 100 to operate.

BJT Q1 amplifies the difference between a reference voltage $V_{ref}$ and a desired value of an output voltage $V_{reg}$. $V_{ref}$ is the sum of the voltages across diode D1, the base-emitter junction of BJT Q1 and resistor R2. Regulator 104 regulates variations in $V_{reg}$, also referred to as regulated voltage, based on the amplified difference between $V_{reg}$ and $V_{ref}$. Regulator 104 regulates $V_{reg}$ by adjusting a current $I_{reg}$ flowing through voltage regulator 100. $I_{reg}$ is the drain-source current, $I_{ds}$, of FET Q2. In one embodiment of the invention, $V_{reg}$ is equal to $V_{ref}$.

$I_{reg}$ flowing through voltage regulator 100 is the sum of a collector current, $I_c$, and a base current, $1_b$, of BJT Q1. In an embodiment of the invention, the value of $I_b$ is less than that of $I_c$ and therefore may be ignored. Therefore, $I_{reg}$ may be considered to be equal to collector current $I_c$. Hence, a variation in the value of $I_c$ causes a variation in $I_{ds}$, which further causes variations in $I_{reg}$. The value of $V_{reg}$ is maintained by FET Q2 through the voltage drop across resistor R1. In one embodiment of the invention, variations in $V_{reg}$ may be caused by variation in load, temperature and voltage $V_{bat}$.

In one embodiment of the invention, if $V_{reg}$ exceeds a desired value, base current, $I_b$, and collector current Ic of BJT Q1 increases. Higher $I_c$ results in higher voltage drop across resistor R1. This makes the gate-source voltage of FET Q2 more negative, thereby resulting in lower drain source current, $I_{ds}$, and subsequently reducing $V_{reg}$.

In another embodiment of the invention, if $V_{reg}$ drops below the desired value, the voltage across the base-emitter junction of BJT Q1 and resistance R2 decreases. Due to the decrease in the voltage across the base-emitter junction of BJT Q1, its collector current $I_c$ reduces. As a result, the voltage drop across resistor R1 reduces. This makes the gate-source voltage of FET Q2 less negative, thereby increasing $I_{ds}$. The increase in $I_{ds}$ results in higher $I_{reg}$, thereby increasing $V_{reg}$.

In one embodiment of the invention, BJT Q1 is a Heterojunction Bipolar Transistor (HBT). In various embodiments of the invention, BJT Q1 may be replaced by any transistor amplifier such as, an operational amplifier, a differential amplifier and the like. In one embodiment of the invention, FET Q2 is a Pseudomorphic High Electron Mobility Transistor (pHEMT). In various embodiments of the invention, FET Q2 is a depletion mode type field effect transistor. In one embodiment of the invention, the value of resistor R2 may be set to zero. The reference voltage, in this case, is the sum of voltages across diode D1 and base-emitter junction of BJT Q1. In various embodiments of the invention, FET Q2 is used as an amplifier.

Diode D1 and emitter-base junction of BJT Q1 provides a temperature coefficient to voltage regulator 100, the temperature coefficient being the change in output voltage, $V_{reg}$, of the voltage regulator 100 per degree centigrade change. Based on the temperature coefficients of the selected components, a regulated voltage with desired temperature dependency may be generated. In various embodiments of the invention, a regulated voltage with desired temperature dependency may be required to provide a specified quiescent current for power amplifier circuits.

In one embodiment of the invention, a parallel combination of a resistor and diode D1 may be implemented in place of diode D1 (not shown) to set the temperature coefficient of $V_{reg}$. In another embodiment of the invention, a series combination of a resistor (not shown) and diode D1 may be implemented in place of diode D1. In still another embodiment of the invention, diode D1 may be replaced by a resistor. In an embodiment of the invention, a Zener diode may be used instead of diode D1. In such a case, an additional resistor is connected between the base of BJT Q1 and ground. The additional resistor supplies the required current to bring the Zener diode into its operating range.

In various embodiments of the invention, the configuration of the components used in voltage regulator 100, like BJT Q1, FET Q2, diode D1, may be selected with respect to the circuit for which voltage regulation is required.

Figure 2:
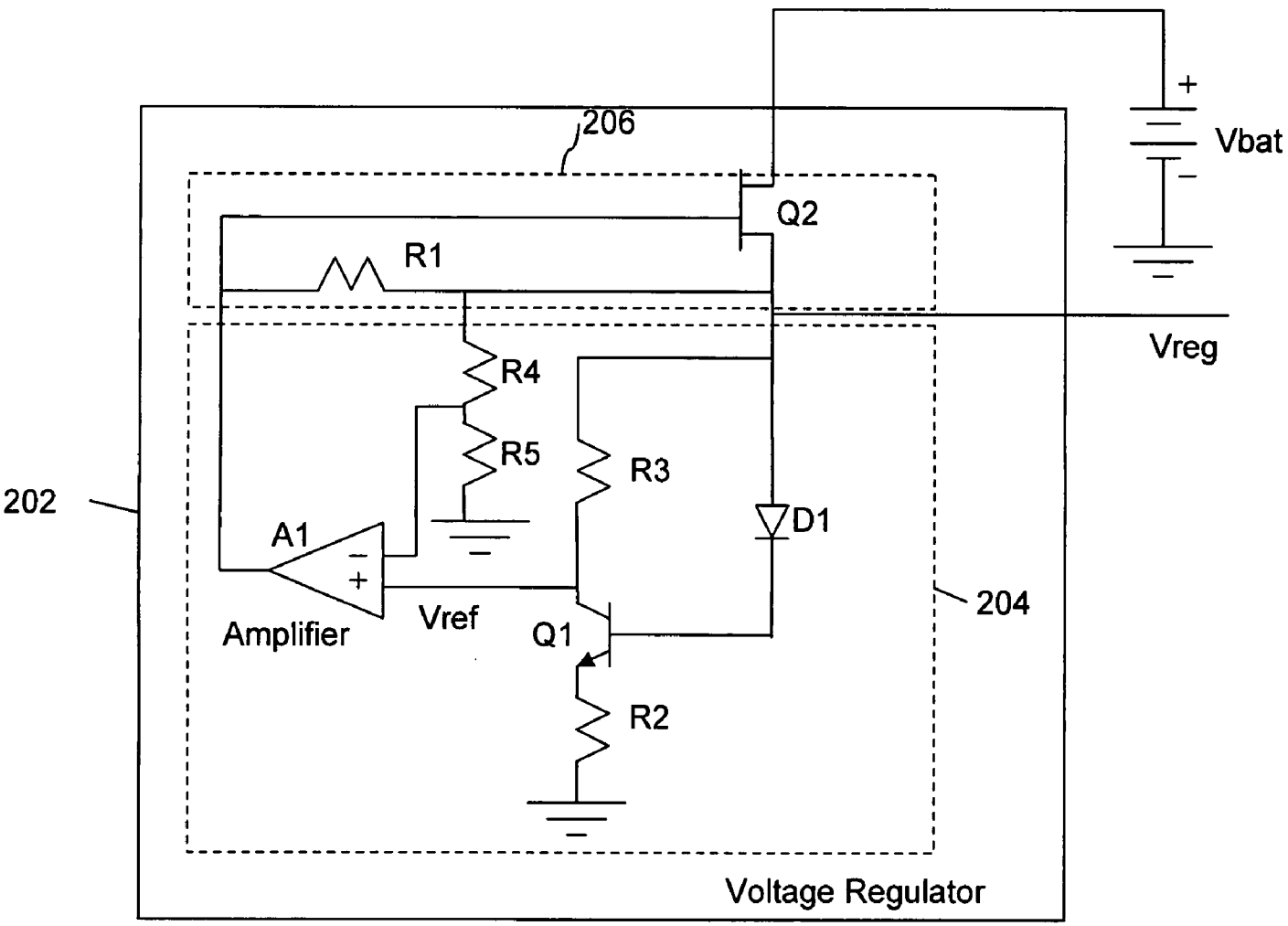
FIG. 2 is a schematic representation of a circuit diagram of a system for voltage regulation, in accordance with another embodiment of the invention.

FIG. 2 is a schematic representation of a circuit diagram of a voltage regulator 202, in accordance with another embodiment of the invention. Voltage regulator 202 includes an error amplifying module 204 and a regulator 206. Error amplifying module 204 includes an amplifier A1, a BJT Q1, a diode D1 and the resistors R2, R3, R4, and R5. Regulator 206 includes a field-effect transistor (FET) Q2 and resistor R1. One input of amplifier A1 is connected to collector of BJT Q1 and other input is connected between resistor R4 and resistor R5. Output of amplifier A1 is connected to gate of FET Q2. Resistor R1 is connected between gate and source of FET Q2. Diode D1 is connected between source of Q2 and base of Q1 of BJT Q1. Resistor R2 is connected to emitter of BJT Q1 and the other end of resistor R2 is grounded. One end of resistor R4 is connected to source of FET Q2 and to one end of resistor R5. The other end of resistor R5 is grounded. A sample of voltage, $V_{reg}$ through the resistive divider made with resistor R4 and resistor R5, is provided to the amplifier A1. Amplifier A1 provides additional amplification of the difference between the actual value of the output voltage and the desired voltage value. The additional amplification provides more stability to voltage regulator 202 against variations caused by battery voltage and load. Regulator 206 regulates the output voltage $V_{reg}$ based on the output of the amplifier A1. In one embodiment of the invention, amplifier A1 may be a differential amplifier. In another embodiment of the invention, amplifier A1 may be an operational amplifier.

Figure 3:
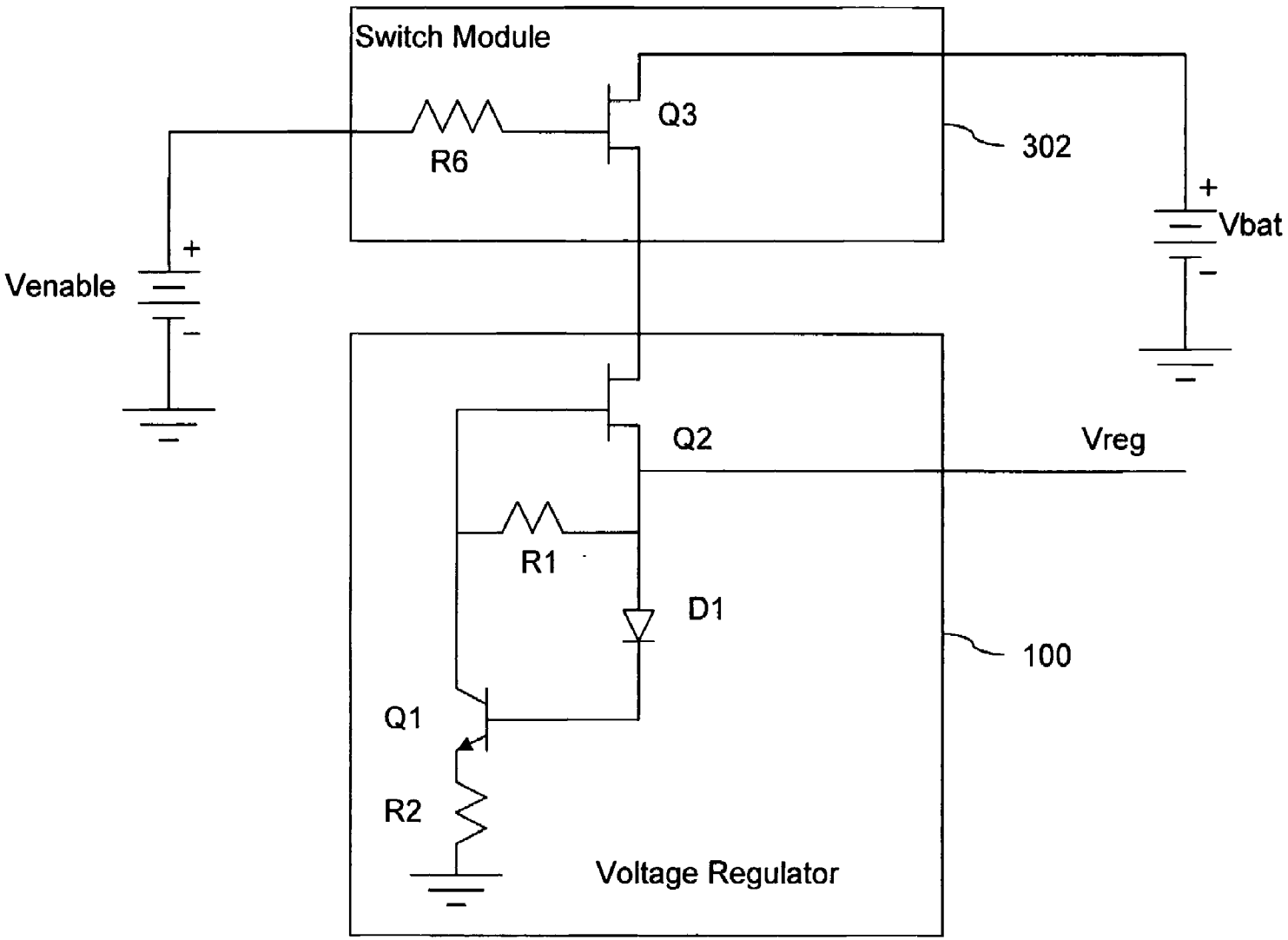
FIG. 3 is a schematic representation of a circuit diagram of a system for voltage regulation with a switch module, in accordance with an embodiment of the invention.

FIG. 3 is a schematic representation of a circuit diagram of voltage regulator 100 with a switch module 302, in accordance with an embodiment of the invention. Switch module 302 includes a field effect transistor (FET) Q3, and a resistor R6. Resistor R6 is connected to the gate of FET Q3. A DC supply battery, $V_{enable}$, provides a control voltage to switch module 302 and controls the functioning of switch module 302. Further, battery, $V_{bat}$, supplies the required power to switch module 302 and to voltage regulator 100.

Switch module 302 turns voltage regulator 100 'On' and 'Off'. In one embodiment of the invention, when the value of $V_{enable}$ is 'High', i.e., when the value of $V_{enable}$ is equal to the operating voltage of FET Q3, switch module 302 turns voltage regulator 100 to 'On' state. In 'On' state switch module 302 passes drain current, $I_{ds}$, into FET Q2, thereby allowing voltage regulator 100 to function. In another embodiment of the invention, voltage supplied by $V_{enable}$ is 'Low', i.e., $V_{enable}$ is adjusted such that no current flows through FET Q3 and voltage regulator 100. This switches voltage regulator 100 to 'Off' state.

Figure 4:
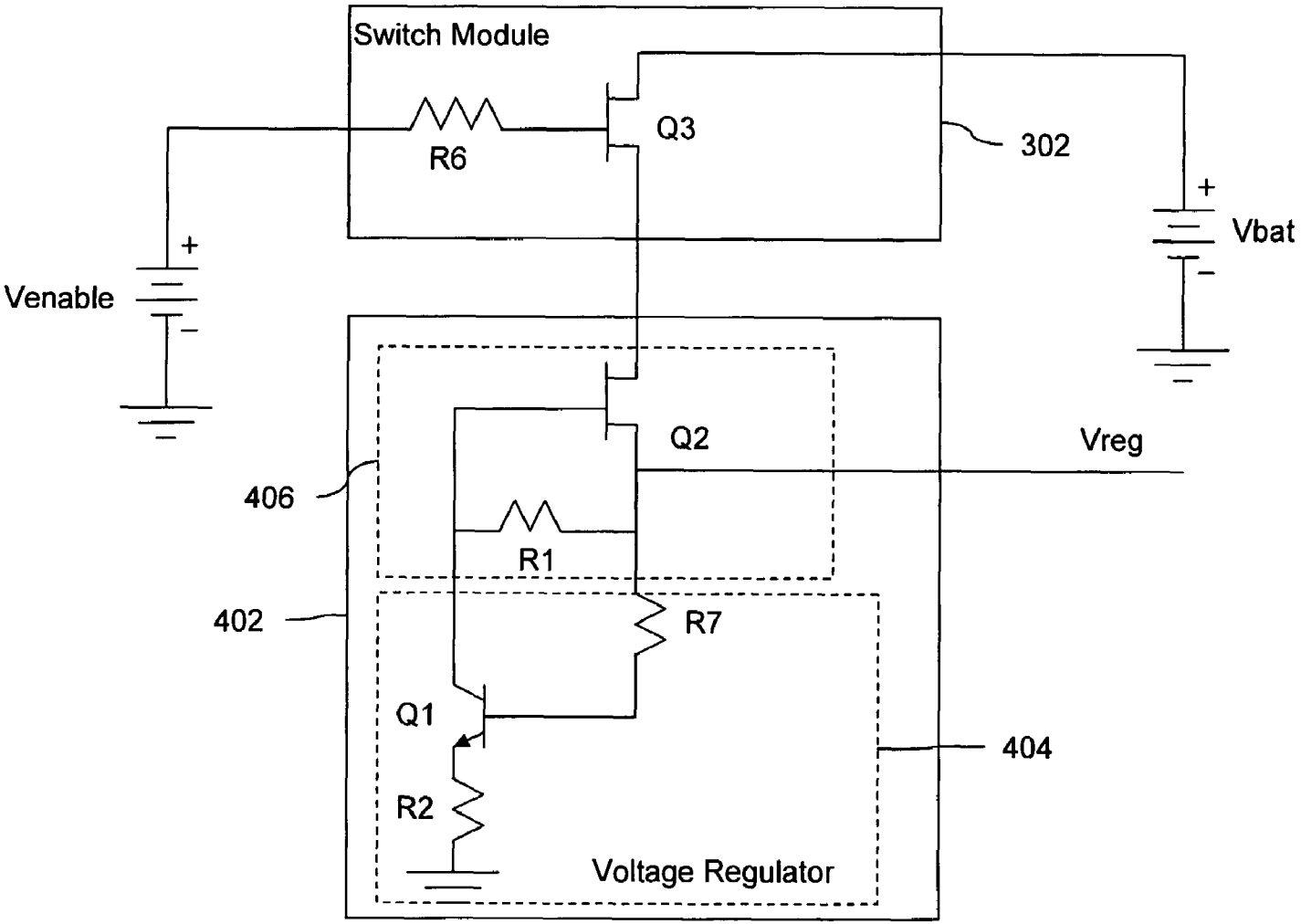
FIG. 4 is a schematic representation of a circuit diagram of a system for voltage regulation with a switch module, in accordance with another embodiment of the invention.

FIG. 4 is a schematic representation of a circuit diagram of a voltage regulator 402 with switch module 302, in accordance with another embodiment of the invention. Voltage regulator 402 includes an error amplifying module 404 and a regulator 406. Switch module 302 is same as described in FIG. 3. Error amplifying module 404 includes a resistor R7, a Bipolar Transistor (BJT) Q1, and a resistor R2. Regulator 406 is similar to regulator 104 as described in FIG. 1. Resistor R7 is connected between the base of BJT Q1 and source of Q2. Resistor R2 is connected between emitter junction of BJT Q1 and ground. The use of resistor R7 instead of diode D1, as shown in FIG. 1, FIG. 2 and FIG. 3, results in a lower temperature dependency of $V_{reg}$, as the reference voltage includes only one temperature dependent element, which is base-emitter junction of BJT Q1. In one embodiment of the invention, value of resistors R2 and/or R7 may be set to zero.

Voltage regulator 100, as described in FIG. 1, FIG. 2 and FIG. 3, may be used with current mirror based bias circuits to provide constant, temperature compensated biasing current to the transistors. The temperature coefficient of output voltage of voltage regulator 100 is based on diode D1 and base-emitter junction of BJT Q1. Further, it keeps the bias current approximately constant with respect to temperature. The use of voltage regulator 100 for providing constant biasing current to transistors is depicted in FIG. 5 and FIG. 6.

Figure 5:
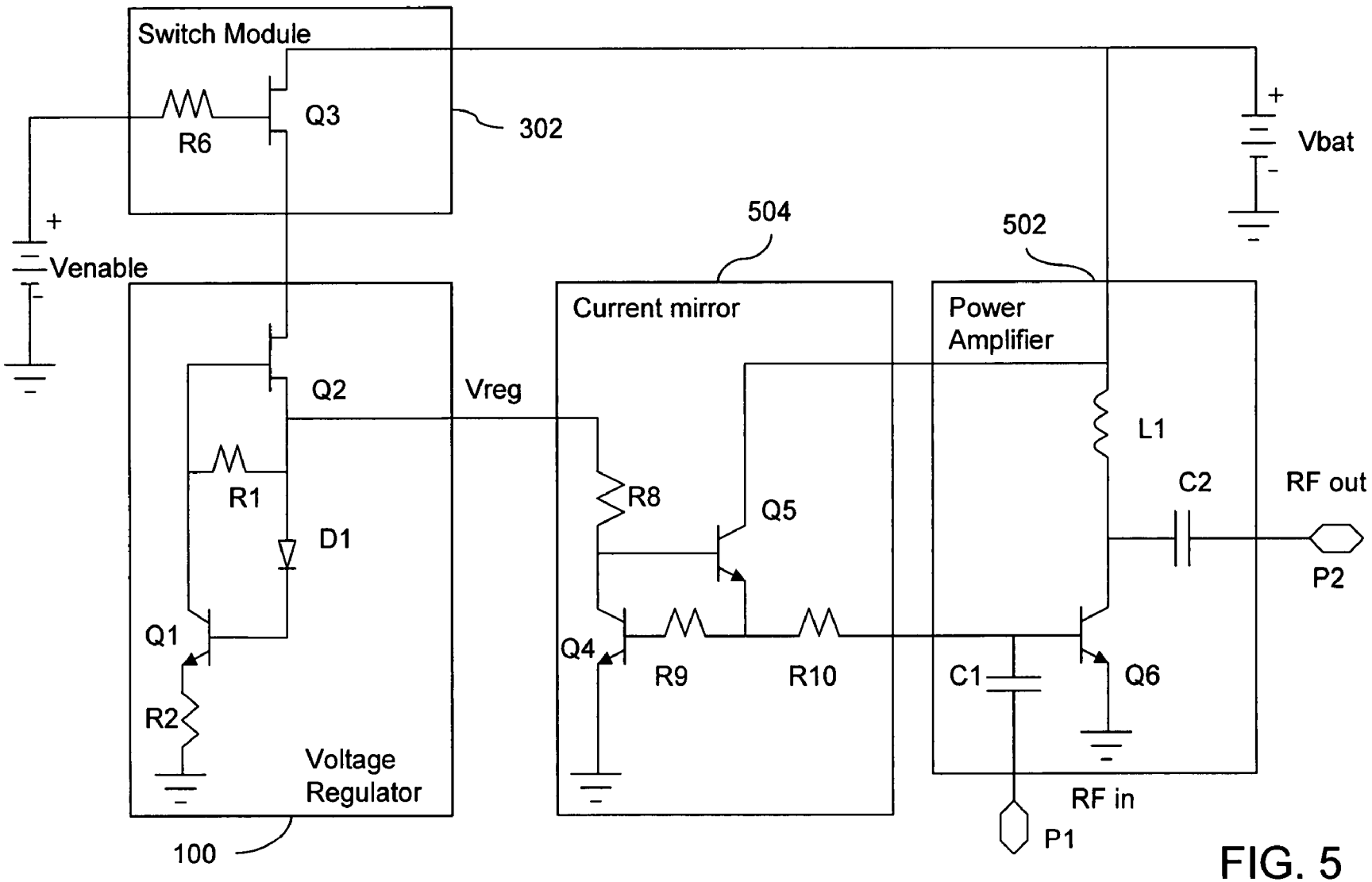
FIG. 5 is a schematic representation of a circuit diagram of a system for voltage regulation with a switch module used with a power amplifier circuit, in accordance with an embodiment of the invention.

FIG. 5 is a schematic representation of a circuit diagram of voltage regulator 100 with switch module 302 being used with a power amplifier 502, in accordance with an embodiment of the invention. Voltage regulator 100 and switch module 302 are connected to power amplifier 502 through a current mirror 504. Power amplifier 502 includes a BJT Q6, capacitors C1 and C2, and an inductor L1. BJT Q6, capacitors C1 and C2, and inductor L1 are connected as shown in FIG. 5. Current mirror 504 includes BJTs Q4 and Q5, resistors R8, R9 and R10. BJTs Q4 and Q5 and resistors R8, R9 and R10 are connected as shown in FIG. 5. Voltage regulator 100 provides output voltage to current mirror 504. This output voltage is power supply and load regulated, but is temperature dependent. The temperature coefficient of output voltage of voltage regulator 100 is similar to that of BJT Q6 of power amplifier 502 and current mirror 504 combined.

Figure 6:
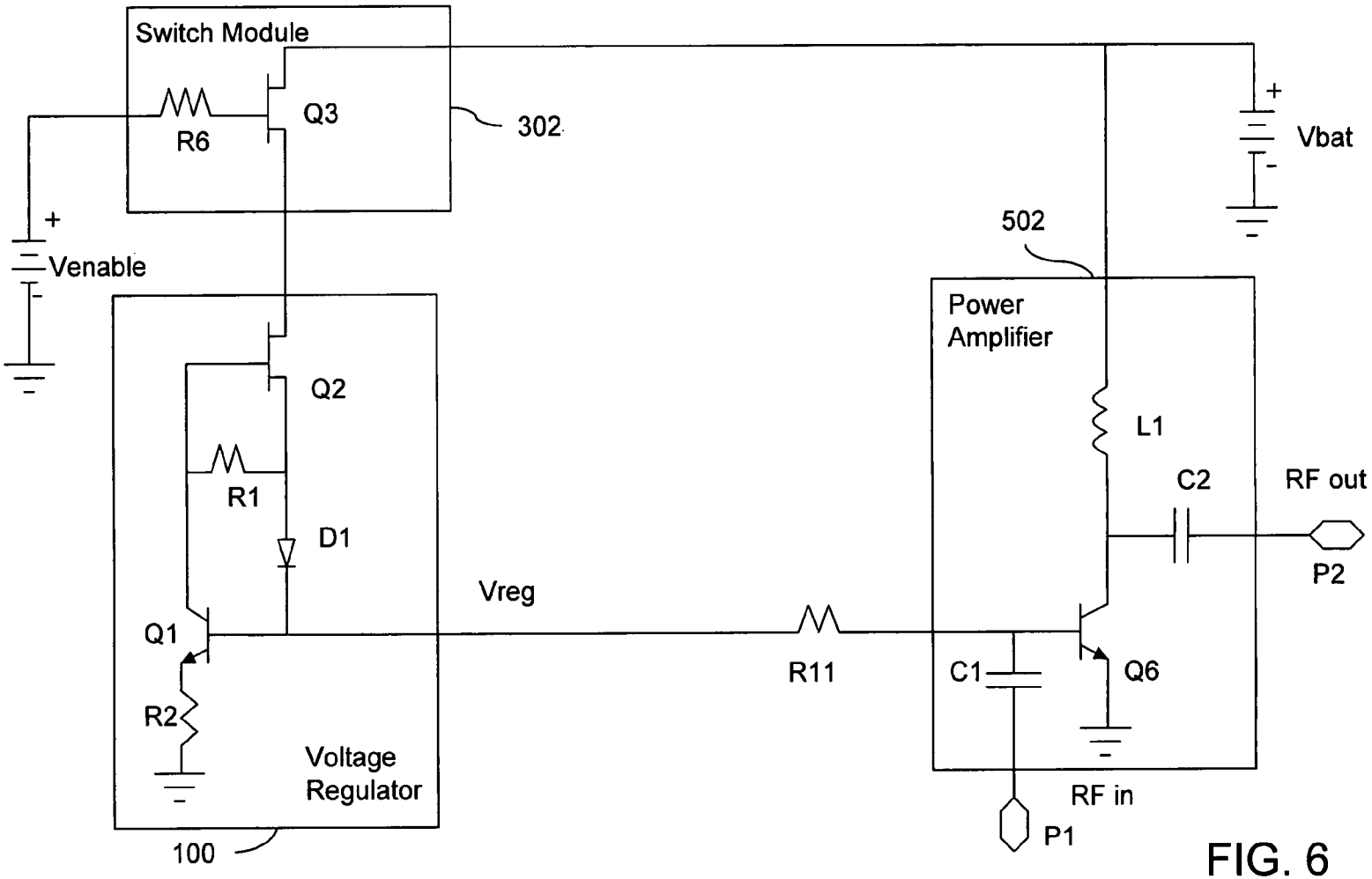
FIG. 6 is a schematic representation of a circuit diagram of a system for voltage regulation with a switch module used with a power amplifier circuit, in accordance with an embodiment of the invention.

FIG. 6 is a schematic representation of the circuit diagram of a voltage regulator 100 with switch module 302 used with a power amplifier 502, in accordance with an embodiment of the invention. Power amplifier 502 is same as described in FIG. 5. Voltage regulator 100 is connected to power amplifier 502 through resistor R11. Voltage regulator 100, as described in FIG. 3 may be used to set quiescent current of a low power transistor Q6, without using current mirror 504. The output voltage of voltage regulator 100 is similar to that of the base-emitter junction of BJT Q1, and has the desired temperature coefficient.

Figure 7:
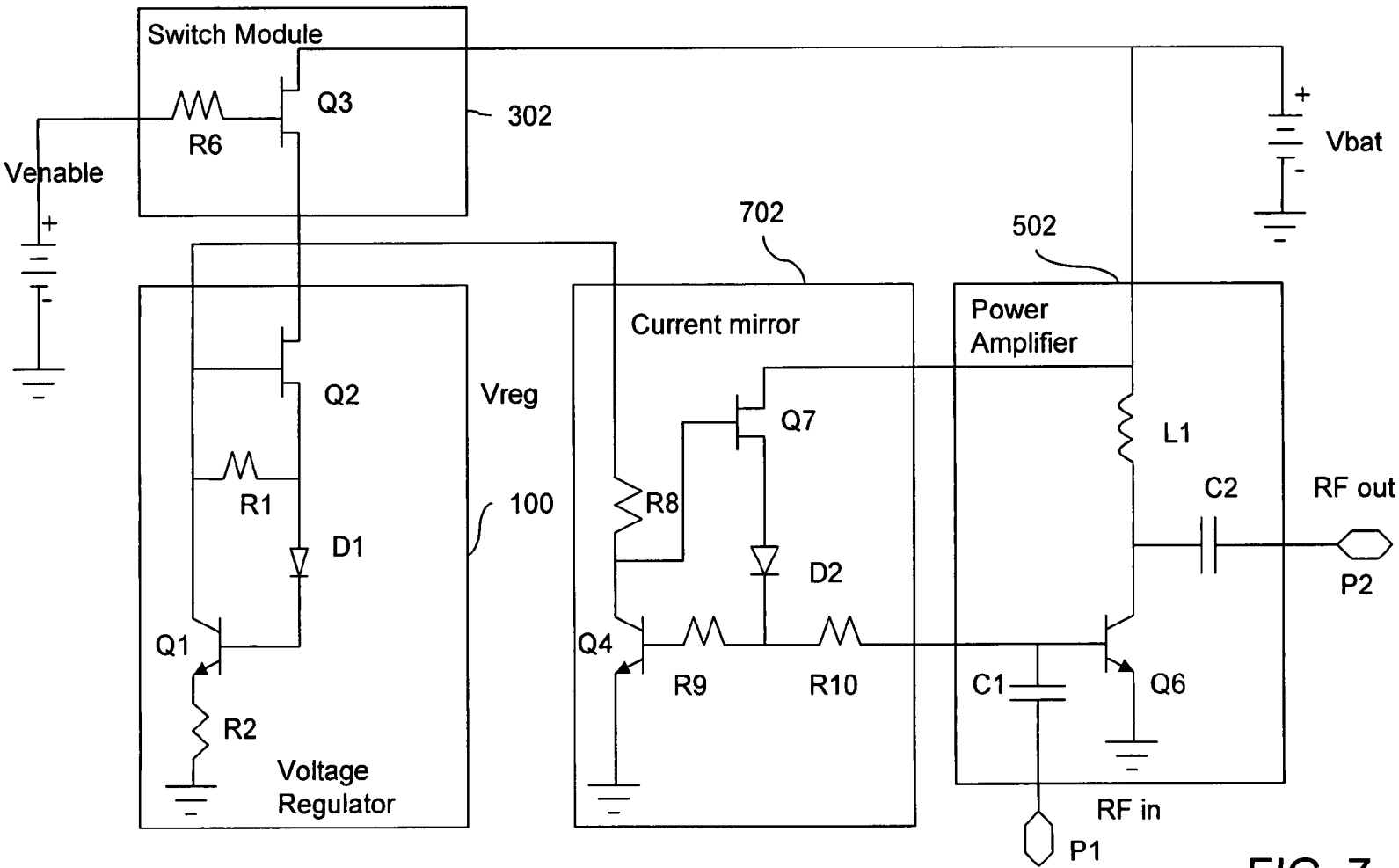
FIG. 7 is a schematic representation of the circuit diagram of the system for voltage regulation with the switch module used with a power amplifier circuit, in accordance with another embodiment of the invention.

FIG. 7 is a schematic representation of a circuit diagram of voltage regulator 100 with switch module 302 being used with power amplifier circuit 502, in accordance with another embodiment of the invention. Voltage regulator 100 is connected to power amplifier circuit 502 through a current mirror circuit 702. Current mirror circuit 702 includes BJT Q4, FET Q7, diode D2, resistors R8, R9 and R10. BJT Q5 shown in current mirror 504 is replaced by FET Q7 and diode D2. Voltage regulator 100 is connected to current mirror circuit 702 through a resistor R8. BJT Q4, FET Q7, diode D2, resistors R8, R9 and R10 are connected as shown in FIG. 7. Source of FET Q7 and resistor R10 are connected to power amplifier circuit 502. BJT Q6, capacitors C1 and C2, and inductor L1 are connected as shown in FIG. 7.

Figure 8:
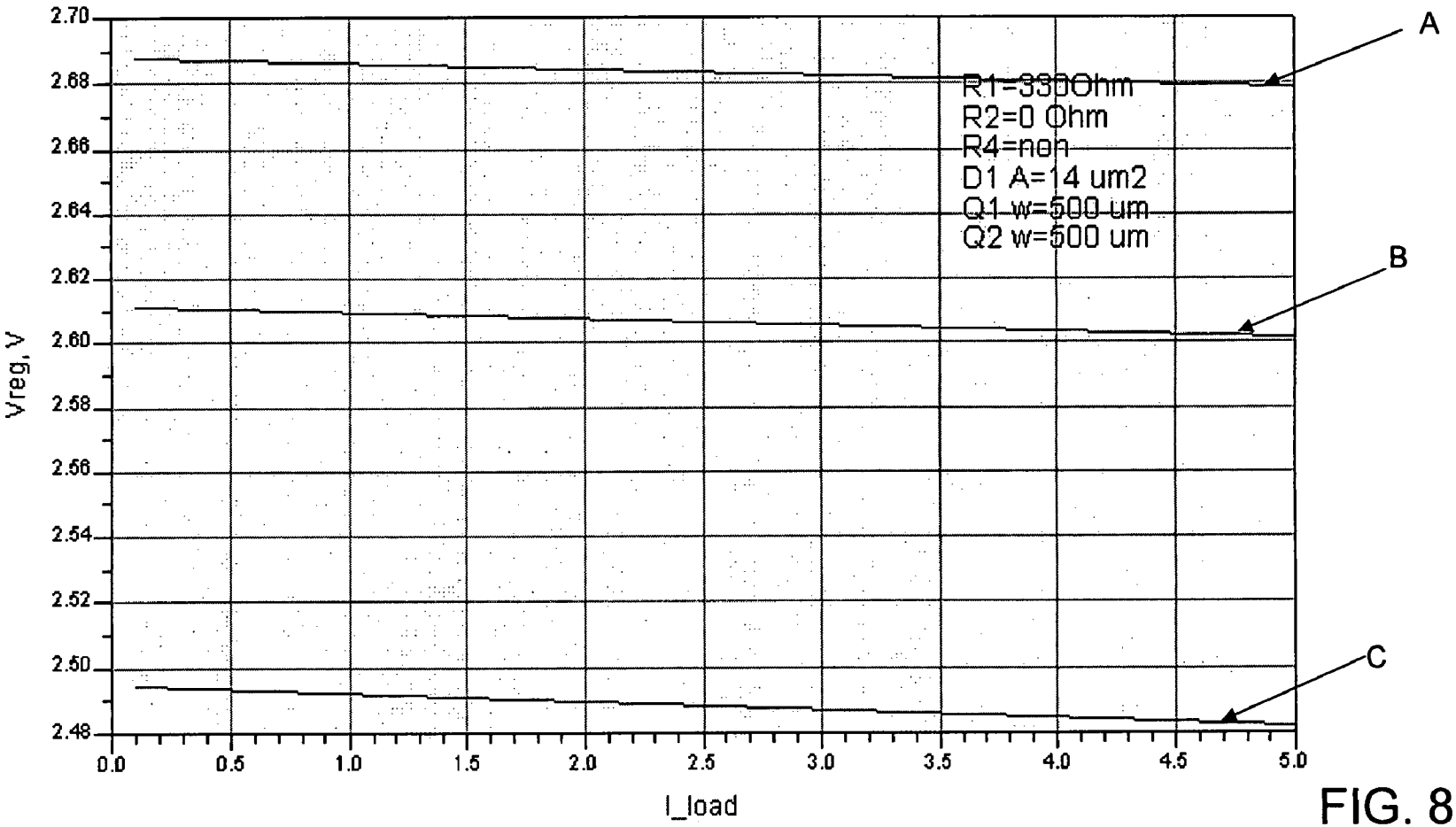
FIG. 8 is a graph illustrating variations in $V_{reg}$, the output voltage of the voltage regulator, versus the variations in load and temperature.

FIG. 8 is a graph illustrating variations in $V_{reg}$, the output voltage of voltage regulator 100 ($V_{reg}$), (in Volts), versus the variations in load current (in milli-Amperes) with temperature. Load current I_load represents the variations caused by load. The graph is generated using the following specifications of the circuit elements of voltage regulator 100 of FIG. 1. The value of resistor R1 is equal to 330 Ohm and resistor R2 is equal to zero. The value of the emitter area of diode D1 is equal to 14 $\mu m^2$. Further, the value of the emitter area of Q1 is equal to 14 $\mu m^2$ and the width of Q2 is equal to 500 μm. Line A shows the variance in desired voltage, $V_{reg}$ (from 2.688 Volts to 2.679 Volts), due to change in load current, I_load (from 0.1 mA to 5 mA) at a temperature of −30° C. Line B shows variance in $V_{reg}$ (from 2.611 Volts to 2.601 Volts), due to change in I_load (from 0.1 mA to 5 mA) at a temperature of 25° C. Line C shows variance in $V_{reg}$ (from 2.494 Volts to 2.482 Volts), due to change in I_load (from 0.1 mA to 5 mA) at a temperature of 110° C.

The voltage regulator as explained above has a number of advantages. Voltage regulator provides stable voltage in case of variations in power supply and load. The voltage regulator provides a desired temperature coefficient. The voltage regulator may be implemented on a single die along with the circuit for which voltage needs to be regulated. Further, the voltage regulator includes a shutdown switch, which allows the voltage regulator to be switched 'On' and 'Off' with negligible leakage. Moreover, the voltage regulator draws less current for providing the desired voltage regulation.

While the foregoing is directed to embodiments of the present invention, other and further embodiments of the invention may be devised (such as by interchanging the source drain terminations where the FETs used are symmetrical devices) without departing from the basic scope thereof, and the scope thereof is determined by the claims that follow.

I claim:

1. A system for voltage regulation of an output voltage with respect to a reference voltage, the system comprising:

an error amplifying module, the error amplifying module comprising a Bipolar Junction Transistor (BJT), a diode, and at least one resistor, the at least one resistor being connected in series with the diode, the error amplifying module amplifying the difference between the reference voltage and a desired value of the output voltage, the reference voltage being the sum of voltages across the BJT and the diode; and a regulator, the regulator comprising a Field Effect Transistor (FET) and a first resistor, the first resistor being connected between the gate and source of the FET, the gate of the FET being further connected to the collector of the BJT , the diode and the at least one resistor being further connected between the base of the BJT and the source of the FET, the emitter of the BJT being further connected to a ground voltage, the regulator regulating variations in the output voltage based on the amplified difference between the reference voltage and the desired value of the output voltage, wherein the reference voltage and the output voltage are available at a junction of the source of the FET, the first resistor and the diode.

2. The system in accordance to claim 1, wherein the BJT is a Heterojunction Bipolar Transistor.

3. The system in accordance to claim 1, wherein the FET is a Pseudomorphic High Electron Mobility Transistor (pHEMT).

4. The system in accordance to claim 1, wherein the error amplifying module further comprises at least one resistor connected between the emitter of the BJT and the ground voltage.

5. The system in accordance to claim 4, wherein the reference voltage is the sum of voltages across the base-emitter junction of the BJT, the diode and the at least one first resistor.

6. The system in accordance to claim 1, wherein the diode is a Zener diode.

7. The system in accordance to claim 1, wherein the error amplifying module further comprises at least one resistor connected in parallel with the diode.

8. The system in accordance to claim 1, wherein the output voltage is temperature dependent, the output voltage being used for biasing bipolar junction transistors.

9. A system for voltage regulation of an output voltage with respect to a reference voltage, the system comprising:

an error amplifying module, the error amplifying module comprising a Bipolar Junction Transistor (BJT), a diode, and at least one resistor, the at least one resistor being connected in series with the diode, the error amplifying module amplifying the difference between the reference voltage and a desired value of the output voltage, the reference voltage being the sum of voltages across the BJT and the diode;

a regulator, the regulator comprising a Field Effect Transistor (FET) and a first resistor, the first resistor being connected between the gate and source of the FET, the gate of the FET being further connected to the collector of the BJT, the diode and the at least one resistor being further connected between the base of the BJT and the source of the FET, the emitter of the BJT being further connected to a ground voltage, the regulator regulating variations in the output voltage based on the amplified difference between the reference voltage and the desired value of the output voltage, wherein the reference voltage and the output voltage are available at a junction of the source of the FET, the first resistor and the diode; and a switch module, the switch module switching the regulator in on or off state, the switch module comprising a second Field Effect Transistor (FET), the second FET being connected between the drain of the first FET and a power supply, wherein the switching is based on change in drain source current of the second FET by applying an appropriate voltage to the gate of the second FET.

10. The system in accordance to claim 9, wherein the switch module further comprises at least one resistor connected to the gate of the second FET.

11. The system in accordance to claim 9, wherein the BJT is a Heterojunction Bipolar Transistor (HBT).

12. The system in accordance to claim 9, wherein the first FET is a Pseudomorphic High Electron Mobility Transistor (pHEMT).

13. The system in accordance to claim 9, wherein the reference voltage is the sum of voltages across the base-emitter junction of the BJT, the diode and the at least one first resistor.

14. The system in accordance to claim 9, wherein the error amplifying module further comprises at least one resistor connected between the emitter of the BJT and the ground voltage.

15. The system in accordance to claim 9, wherein the diode is a Zener diode.

16. The system in accordance to claim 9, wherein the error amplifying module further comprises at least one resistor connected in parallel with the diode.

17. The system in accordance to claim 9, wherein the second FET is used as a switch.

18. The system in accordance to claim 9, wherein the first FET is used as an amplifier.

19. A voltage regulated power supply system, the voltage regulated power supply system comprising;

a voltage regulator, the voltage regulator comprising:

an error amplifying module, the error amplifying module comprising a Bipolar Junction Transistor (BJT), a diode, and at least one resistor, the at least one resistor being connected in series with the diode, the error amplifying module amplifying the difference between the reference voltage and a desired value of the output voltage, the reference voltage being the sum of voltages across the BJT and the diode;

a regulator, the regulator comprising a Field Effect Transistor (FET) and a first resistor, the first resistor being connected between the gate and source of the FET, the gate of the FET being further connected to the collector of the BJT, the diode and the at least one resistor being further connected between the base of the BJT and the source of the FET, the emitter of the BJT being further connected to a around voltage, the regulator regulating variations in the output voltage based on the amplified difference between the reference voltage and the desired value of the output voltage, wherein the reference voltage and the output voltage are available at a junction of the source of the FET, the first resistor and the diode; and a power amplifying circuit, the power amplifying circuit receiving the regulated voltage from the voltage regulator, the regulated voltage being used for setting a quiescent current of the power amplifying circuit.

20. The system in accordance to claim 19 further including a switch module, the switch module comprising a second field effect transistor (FET) and one or more second resistors, the one or more second resistors being connected to the gate of the second FET in series, the second FET being connected between the drain of the first FET and a power supply, the switch module switching the voltage regulator in on or off state based on the change in drain source current of the second FET by applying an appropriate voltage to the gate of the second FET.

* * * * *